US009751298B2

(12) United States Patent
Ueyama et al.

(10) Patent No.: US 9,751,298 B2
(45) Date of Patent: Sep. 5, 2017

(54) CUTTING APPARATUS, CUTTING METHOD, AND PRINTING APPARATUS

(71) Applicant: Seiko Epson Corporation, Tokyo (JP)

(72) Inventors: Naohiro Ueyama, Matsumoto (JP); Naoto Hayakawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/197,862

(22) Filed: Jun. 30, 2016

(65) Prior Publication Data

US 2017/0008316 A1 Jan. 12, 2017

(30) Foreign Application Priority Data

Jul. 9, 2015 (JP) ..... 2015-137840

(51) Int. Cl.

| | |
|---|---|
| ***B41J 11/70*** | (2006.01) |
| ***B41J 11/00*** | (2006.01) |
| ***B41J 2/01*** | (2006.01) |
| ***B26D 1/18*** | (2006.01) |

(52) U.S. Cl.

CPC *B41J 2/01* (2013.01); *B26D 1/18* (2013.01); *B41J 11/706* (2013.01)

(58) Field of Classification Search

CPC ..... B41J 11/70; B41J 11/0045; B41J 11/706; B41J 2/01; B26D 1/18; B26D 7/01; B26D 2007/082; B65H 35/00

See application file for complete search history.

(56) References Cited

U.S. PATENT DOCUMENTS

2009/0226236 A1* 9/2009 Yamashita ..... B26D 1/185 400/621

FOREIGN PATENT DOCUMENTS

| | | |
|---|---|---|
| JP | 2011-045958 A | 3/2011 |
| JP | 2011-046101 A | 3/2011 |

* cited by examiner

*Primary Examiner* — Huan Tran
*Assistant Examiner* — Alexander D Shenderov
(74) *Attorney, Agent, or Firm* — Workman Nydegger

(57) ABSTRACT

A cutting apparatus includes a cutting blade that cuts a medium and a casing that holds the cutting blade. The casing has a first passageway in which the medium passing through contacts the cutting blade and a second passageway in which the medium passing through does not contact the cutting blade.

4 Claims, 7 Drawing Sheets

CUTTING APPARATUS, CUTTING METHOD, AND PRINTING APPARATUS

BACKGROUND

1. Technical Field

The present invention relates to a cutting apparatus that cuts a medium, a cutting method for the cutting apparatus, a printing apparatus that includes the cutting apparatus.

2. Related Art

There has been known a printer that performs printing on a medium that is transported. Such printers include a printer that is equipped with a cutter apparatus (cutting apparatus) that cuts a medium having been subjected to printing into a desired size. For example, a printer described in JP-A-2011-46101 is equipped with a cutter apparatus that cuts a medium as a cutter holder (casing) that holds a rotary blade for cutting the medium is moved back and forth in the scanning directions that intersect with the transport direction of the medium.

In such a cutter apparatus, when the cutter holder moves back and forth, there is a risk that a medium, after being cut during an outgoing movement of the cutter holder, may be cut again during the returning movement of the cutter holder (i.e., a risk of the double cutting of the medium). Therefore, in the cutter apparatus provided in the printer described in JP-A-2011-46101, the risk of a medium being cut twice when the cutter holder moves back and forth is reduced by pushing the medium having been cut during the outgoing movement of the cutter holder toward a downstream side in the transport direction of the medium during the returning movement of the cutter holder. However, in such a configuration, since the medium having been cut is pushed toward the downstream side in the transport direction of the medium, a load acts on the medium, giving rise to a risk of breaking or bending the medium.

SUMMARY

An advantage of some aspects of the invention is that a cutting apparatus capable of restraining the double cutting of a medium while reducing the load that acts on the medium, a cutting method for the cutting apparatus, and a printing apparatus equipped with the cutting apparatus are provided.

Configurations, operations, and advantageous effects realized by some aspects of the invention will be described below.

A cutting apparatus according to one aspect of the invention includes a cutting blade that cuts a medium and a casing that holds the cutting blade and that has a first passageway in which the medium passing through contacts the cutting blade and a second passageway in which the medium passing through does not contact the cutting blade.

According to this aspect of the invention, because the casing is provided with the second passageway in which the medium does not contact the cutting blade, one of the medium and the cutting apparatus can be moved across the other without cutting the medium. Therefore, it is possible to restrain the double cutting of the medium while reducing the load that acts on the medium.

In the foregoing cutting apparatus, the cutting apparatus may further include a guide portion that switches between passage of the medium through the first passageway and passage of the medium through the second passageway.

According to this embodiment, the passageway through which the medium pass through can be changed by the guide portion.

In the foregoing cutting apparatus, the casing may be movable back and forth in scanning directions and the guide portion may be displaceable to a first position in which the guide portion allows the medium to pass through the first passageway when the casing moves from one side to another side in the scanning directions and a second position in which the guide portion guides the medium to the second passageway when the casing moves from the another side to the one side.

According to this embodiment, the passageway through which the medium is caused to pass can be changed by displacing the guide portion between the first position and the second position according to the direction of movement of the casing when the casing moves back and forth in the scanning directions. That is, a simple configuration made up of the guide portion displaceable between the first position and the second position makes it possible to guide the medium so that the medium passes through different passageways between during the outgoing movement and during the returning movement of the casing when the casing moves back and forth.

In the foregoing cutting apparatus, the guide portion may be displaced from the second position to the first position by the medium passing through the first passageway and contacting the guide portion when the casing moves from the one side to the another side in the scanning directions.

According to this embodiment, the position of the guide portion can be displaced without providing a power source, for example, a motor, an actuator, etc.

In the foregoing cutting apparatus, the guide portion may block the first passageway when the guide portion is positioned in the second position.

According to this embodiment, the risk of the medium erroneously passing through the first passageway is reduced. That is, the double cutting of the medium can be restrained.

In the foregoing cutting apparatus, when the casing is viewed from above, the first passageway and the second passageway may be provided at positions at which the first passageway and the second passageway at least partially overlap with each other.

According to this embodiment, in a top view of the casing, the area that the first passageway and the second passageway occupy is made small. Therefore, this contributes to a compact configuration of the cutting apparatus.

A printing apparatus according to another aspect of the invention includes any one of the cutting apparatuses described above and a printing portion that prints an image on the medium.

According to this aspect of the invention, because the casing is provided with the second passageway in which the medium does not contact the cutting blade, one of the medium and the cutting apparatus can be moved across the other without cutting the medium. Therefore, it is possible to restrain the double cutting of the medium while reducing the load that acts on the medium.

A cutting method according to still another aspect of the invention is a cutting method employed by a cutting apparatus that includes a cutting blade that cuts a medium, a first passageway in which the medium passing through contacts the cutting blade, and a second passageway in which the medium passing through does not contact the cutting blade. The cutting method includes cutting the medium when the medium is caused to pass through the first passageway and avoiding cutting the medium when the medium is caused to pass through the second passageway.

According to this aspect of the invention, because the casing is provided with the second passageway in which the medium does not contact the cutting blade, one of the medium and the cutting apparatus can be moved across the other without cutting the medium. Therefore, it is possible to restrain the double cutting of the medium while reducing the load that acts on the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an exemplary embodiment of an ink jet type printer (hereinafter, sometimes referred to simply as "printer") that is a kind of printing apparatus equipped with a cutting apparatus will be described with reference to the drawings.

Figure 1:
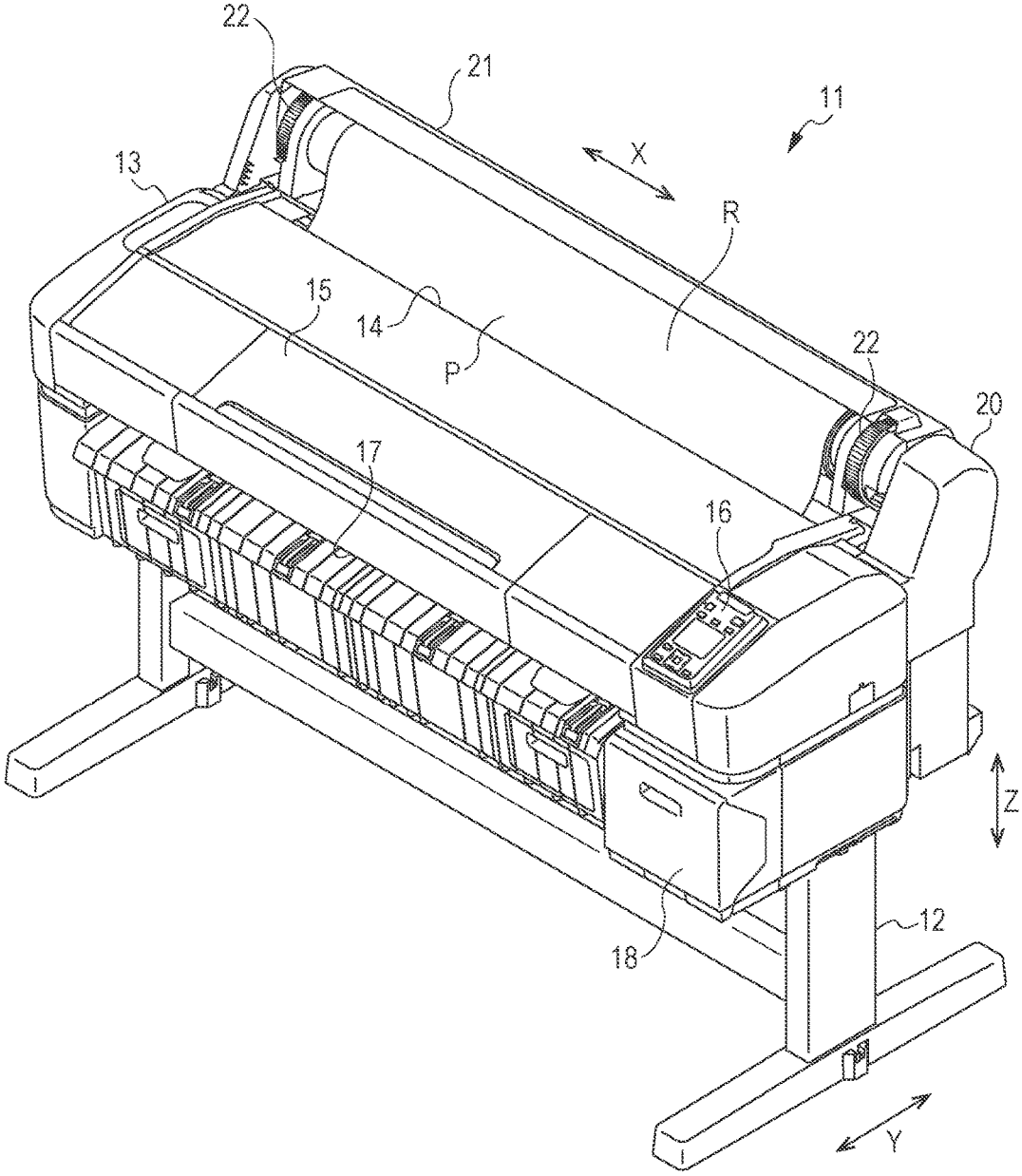
FIG. 1 is a perspective view of an exemplary embodiment of a printer equipped with a cutting apparatus.

As shown in FIG. 1, a printer (printing apparatus) 11 includes a rectangular parallelepipedic case 13 supported by a leg base 12 and a feed section 20 attached to a rear surface portion of the case 13 and protruded upward from the rear surface portion. A roll paper sheet R that is a cylindrically rolled-up paper sheet P that is an example of a medium has been set in the feed section 20. The feed section 20 includes a feed cover 21 configured to be capable of being opened and closed and to cover the roll paper sheet R set in the feed section 20. The feed section 20 further includes holder units 22 that hold the roll paper sheet R rotatably. The holder units 22 are provided at two ends of the feed section 20 in its lengthwise directions (left-right directions in FIG. 1).

An upper portion of the case 13 which is at a rear surface side of the case 13 has a feed opening 14 for feeding the paper sheet P unwound from the roll paper sheet R set in the feed section 20 into the case 13. An upper portion of the case 13 which is at a front surface side of the case 13 that is opposite to the rear surface side thereof has a maintenance cover 15 that is configured to be capable of being opened and closed so as to allow maintenance to be performed with respect to the inside of the case 13. Furthermore, an upper portion of the case 13 which is at an end of the case 13 in the lengthwise directions of the case 13 (a right end in FIG. 1) is provided with an operating portion 16 for operating the printer 11. A front surface of the case 13 has an outlet opening 17 for allowing the paper sheet P having fed into the case 13 from the feed opening 14 to move out of the case 13. Furthermore, a front surface of the case 13 which is at an end in the lengthwise direction (the right end in FIG. 1) is provided with a liquid container holder portion 18 in which a liquid container that contains a liquid that is a printing agent, for example, ink, is detachably held.

Figure 2:
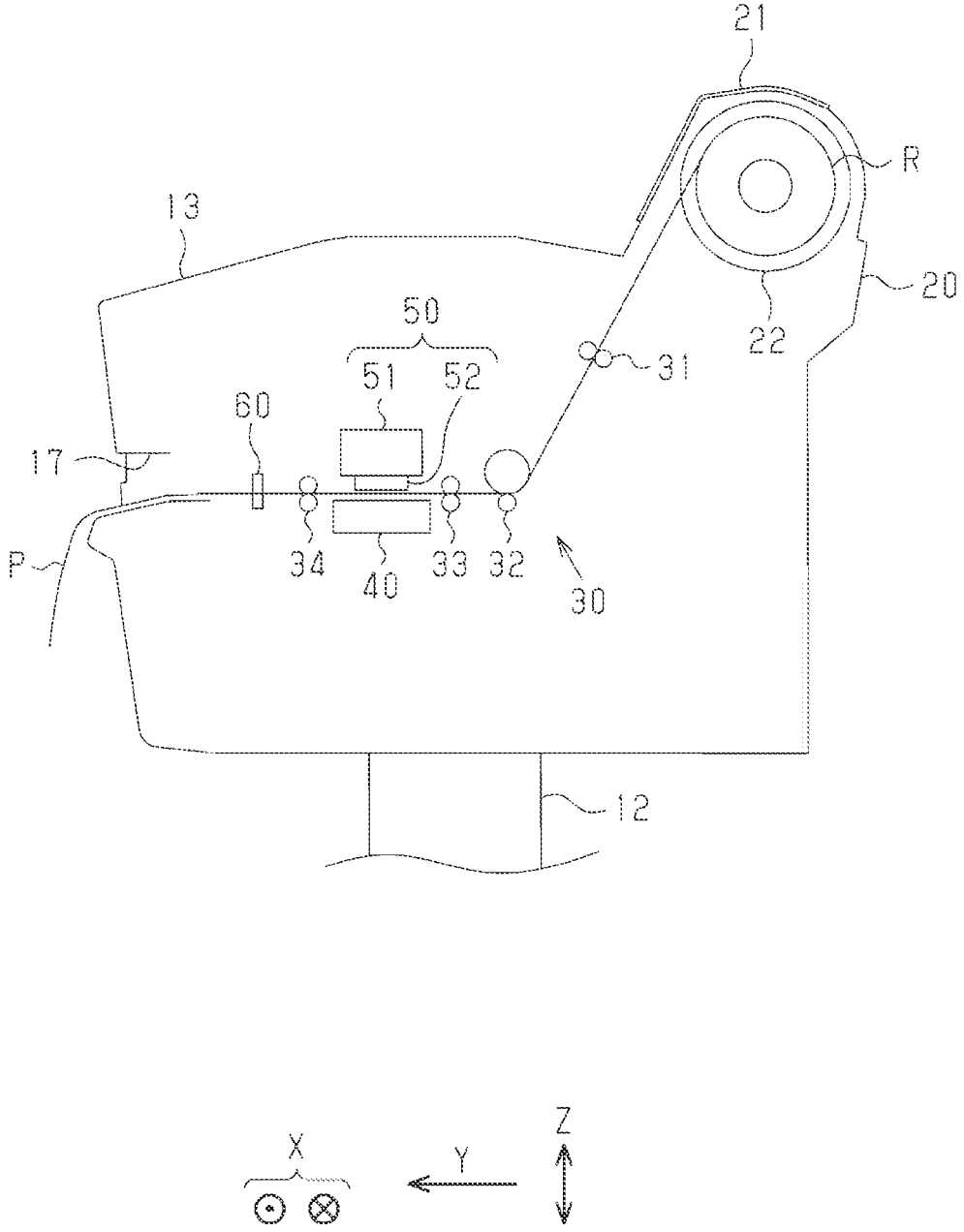
FIG. 2 is a side sectional view schematically illustrating an internal structure of a printer.

As shown in FIG. 2, the case 13 contains a transport section 30 that transports the paper sheet P fed from the feed section 20, a support base 40 that supports the paper sheet P from a lower side in vertical directions Z, a printing section 50 that prints images, such as characters or photographs, on the paper sheet P supported by the support base 40, and a cutting mechanism 60 that cuts the printed paper sheet P. The transport section 30 includes a plurality of transport rollers 31, 32, 33 and 34 that support the paper sheet P by pinching the paper sheet P from both obverse and reverse surfaces of the paper sheet P. The paper sheet P sent out of the feed section 20 is transported along a transport direction Y by rotationally driving the transport rollers 31 to 34.

The printing section 50 provided above the support base 40 in the vertical directions Z includes a printing carriage 51 movable back and forth along scanning directions X that are orthogonal to the plane of the drawing in FIG. 2 and a head 52 that has been mounted on the printing carriage 51 and that performs printing by discharging ink to the paper sheet P transported by the transport section 30. That is, the printing section 50 performs printing over substantially the entire area of the paper sheet P in the scanning directions X, which intersect with the transport direction Y, by moving in the scanning directions X. Note that, in this exemplary embodiment, the scanning directions X coincide with the lengthwise directions of the case 13 and the feed section 20, and the vertical directions Z intersect with both the transport direction Y and the scanning directions X.

The paper sheet P printed by the printing section 50 is cut by the cutting mechanism 60 that is provided downstream of the printing section 50 in the transport direction Y. The paper sheet P is thus cut into a cut sheet that is then let out of the case 13 through the outlet opening 17.

Next, the cutting mechanism 60 will be described.

Figure 3:
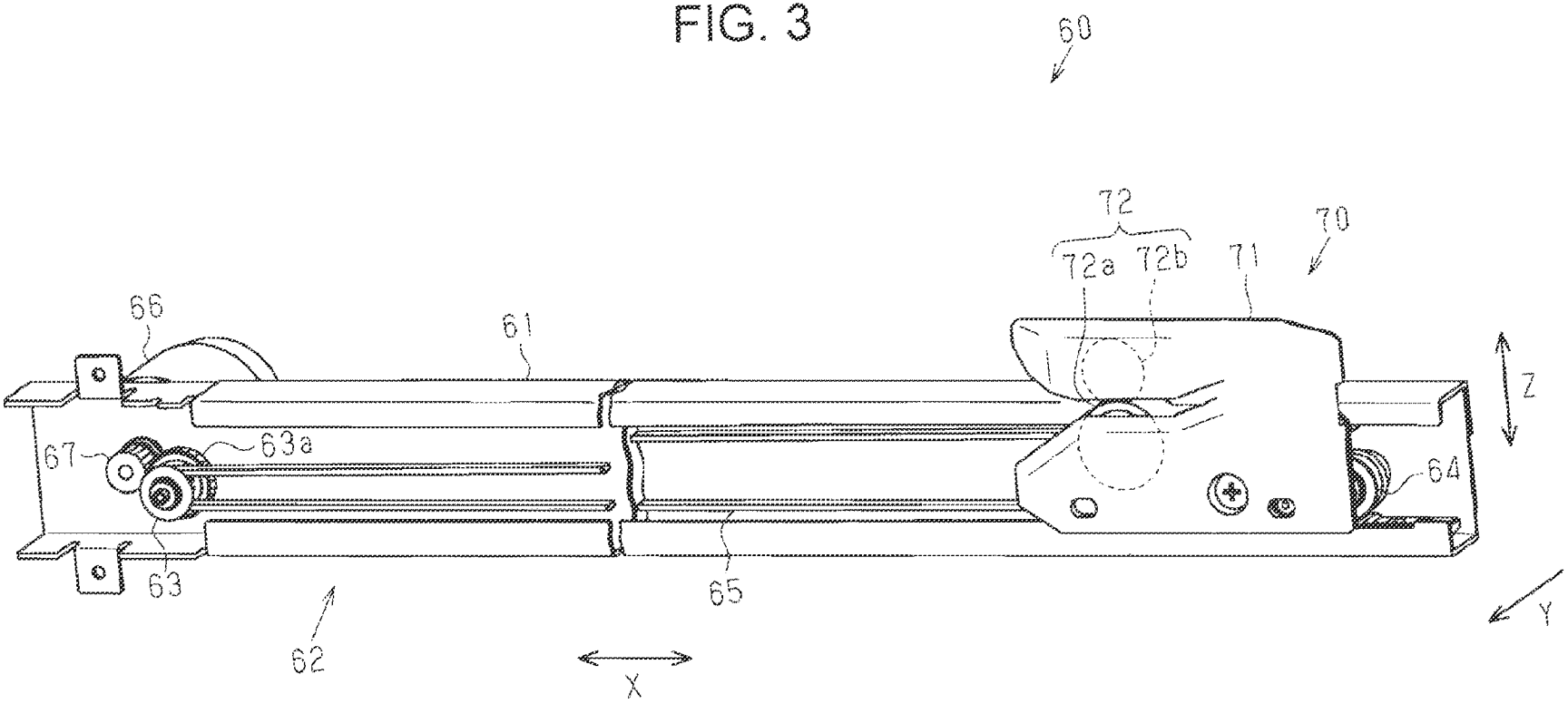
FIG. 3 is a perspective view of a cutting mechanism.

As shown in FIG. 3, the cutting mechanism 60 includes a guide rail 61 provided so as to extend along the scanning directions X and a cutting apparatus 70 that cuts the paper sheet P by moving along the guide rail 61. The cutting apparatus 70 includes a casing 71 attached so as to be movable back and forth along the guide rail 61 and a cutting blade 72 that is held by the casing 71 and that cuts the paper sheet P. That is, the cutting apparatus 70 includes the cutting blade 72 that cuts the medium. Furthermore, the cutting apparatus 70 includes the casing 71 that holds the cutting blade 72. The casing 71 is movable back and forth in the scanning directions X.

The cutting blade 72 is made up of a driving blade 72*a* that is rotationally driven as the casing 71 is moved and a driven blade 72*b* that is passively rotated by the rotation of the driving blade 72*a*. The driving blade 72*a* and the driven blade 72*b* are juxtaposed in the vertical directions Z. That is, the cutting apparatus 70 is provided to be movable back and forth in the scanning directions X.

The guide rail 61 is longer in the scanning directions than the roll paper sheet R that can be set in the feed section 20. The cutting apparatus 70 is attached to a surface of the guide rail 61 which faces downstream in the transport direction Y. Within the guide rail 61 there is provided a transmission mechanism 62 for moving the cutting apparatus 70 back and forth in the scanning directions X.

The transmission mechanism 62 includes pulleys 63 and 64 provided at both ends of the guide rail 61 in the scanning directions X and an annular belt 65 wrapped around the pulleys 63 and 64. Furthermore, on the same axis as the pulley 63 provided at the left end of the guide rail 61 in FIG. 3 there is provided a gear wheel 63*a* that is rotatable together with the pulley 63. The casing 71 of the cutting apparatus 70 is connected to the belt 65 via a connecting member (not graphically shown).

An electric motor 66 is provided at an end of the guide rail 61 in the scanning directions X (the left end in FIG. 3). A pinion 67 is attached to an output shaft of the electric motor 66. The electric motor 66 is attached to the guide rail 61 so that the pinion 67 meshes with the gear wheel 63*a* that is provided coaxially with the pulley 63. The pinion 67 is driven to rotate by the electric motor 66. As the pinion 67 rotates, the pulley 63 is rotated via the gear wheel 63*a*. Then, as the pulley 63 rotates, the pulley 64 is rotated via the belt 65. As the belt 65 is thus driven, the cutting apparatus 70 is moved along the guide rail 61. That is, the transmission mechanism 62 transmits the drive from the electric motor 66 to the casing 71.

Note that, as shown in FIG. 3, a standby position of the casing 71 is set on a right end side of the guide rail 61 in this exemplary embodiment. When the electric motor 66 is driven in a normal rotation direction, the casing 71 is moved toward a left end side of the guide rail 61, that is, toward a counter-standby position opposite to the standby position. When the electric motor 66 is driven in the reverse rotation direction, the casing 71 is moved toward the right end side of the guide rail 61, that is, toward the standby position.

Furthermore, when the casing 71 is moved toward the counter-standby position, the driving blade 72*a* that constitutes the cutting blade 72 is driven by the belt 65 to rotate clockwise in FIG. 3. That is, the driven blade 72*b* is rotated counterclockwise. On the other hand, when the casing 71 is moved toward the standby position, the driving blade 72*a* and the driven blade 72*b* are rotated in the directions opposite to the directions in which the driving blade 72*a* and the driven blade 72*b* are rotated when the casing 71 is moved toward the counter-standby position.

Next, a configuration of the cutting apparatus 70 will be described.

Figure 4:
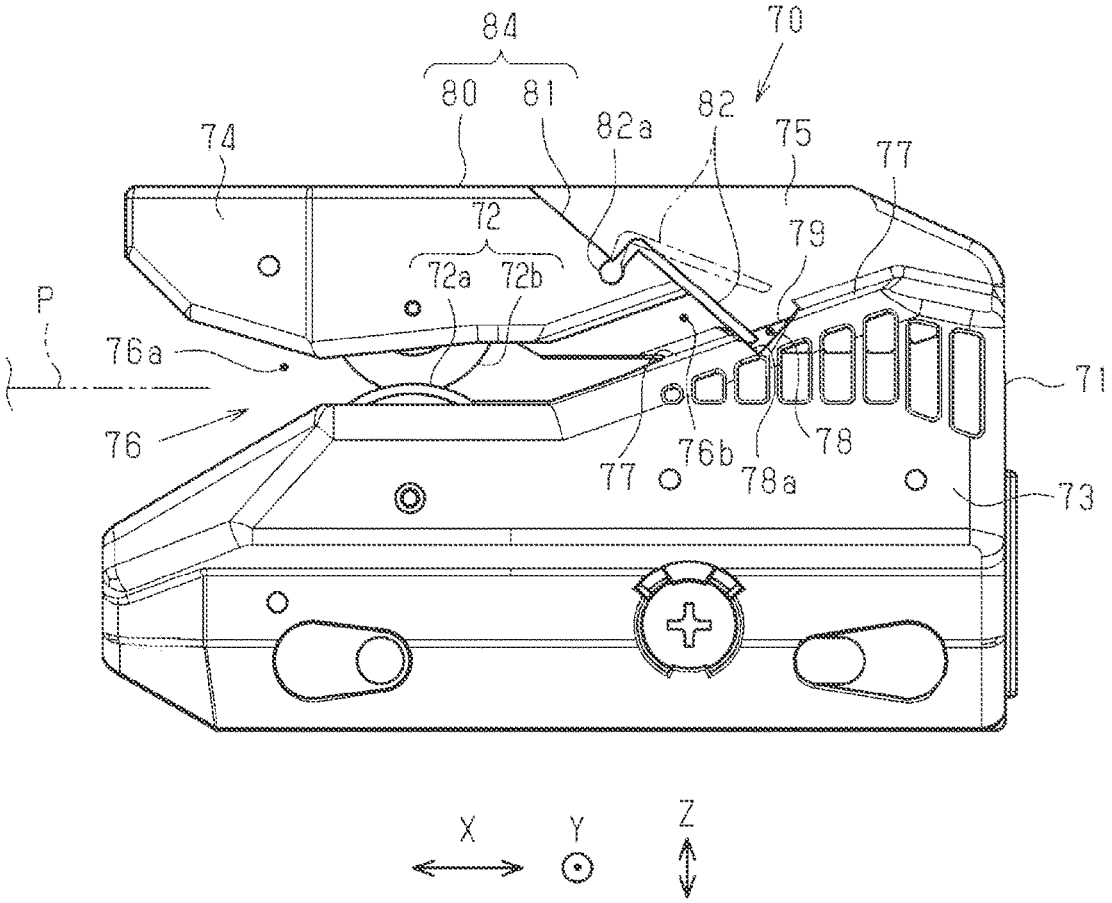
FIG. 4 is a front view of a cutting apparatus.
Figure 5:
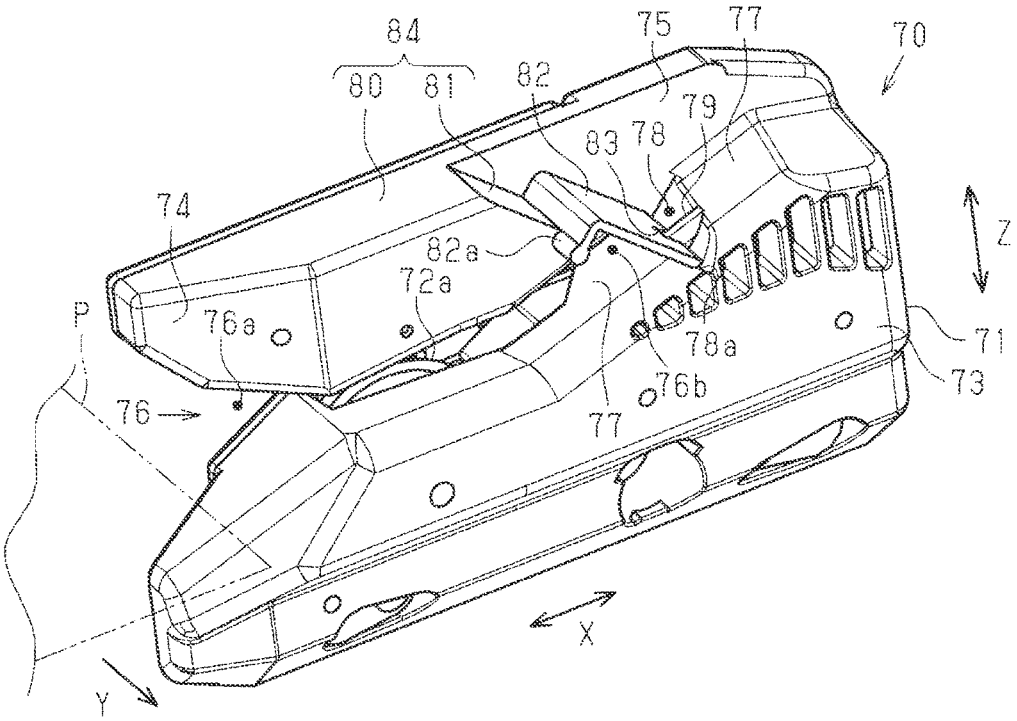
FIG. 5 is a perspective view of the cutting apparatus when a guide portion is positioned in a second position.
Figure 6:
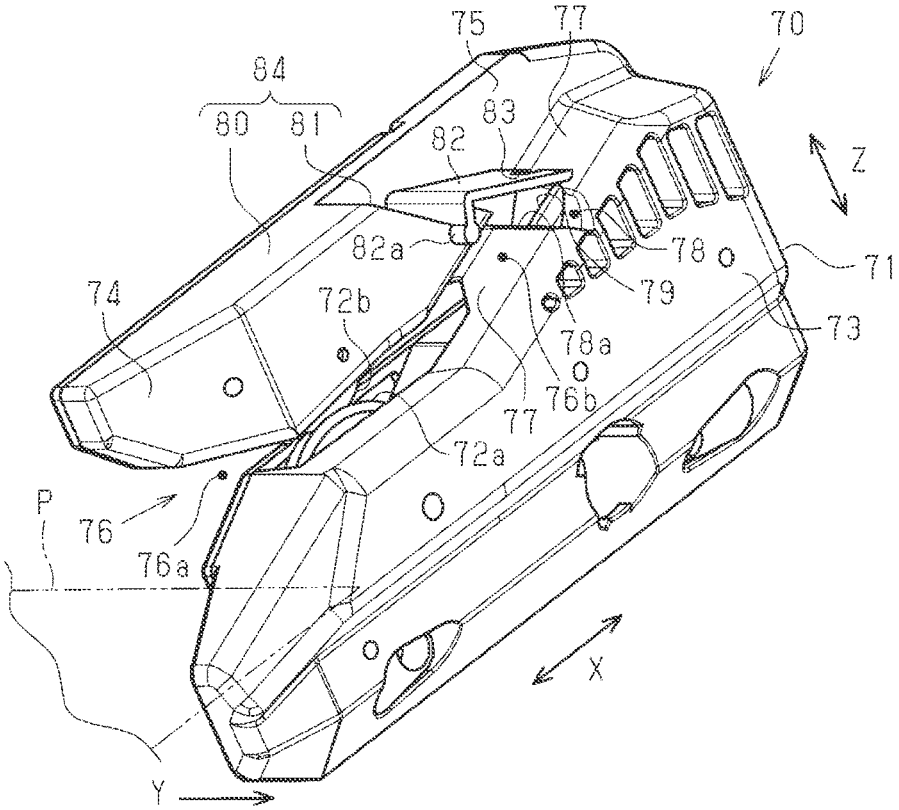
FIG. 6 is a perspective view of the cutting apparatus when the guide portion is positioned at a first position.

As shown in FIGS. 4, 5 and 6, the casing 71 that holds the cutting blade 72 includes a lower-side portion 73 that holds the driving blade 72*a*, an upper-side portion 74 that holds the driven blade 72*b*, and a connecting portion 75 that connects the lower-side portion 73 and the upper-side portion 74. As shown in FIGS. 5 and 6, the connecting portion 75 connects the lower-side portion 73 and the upper-side portion 74 at a portion of the casing 71 which is at the upstream side in the transport direction Y.

As shown in FIGS. 4, 5 and 6, between the lower-side portion 73 and the upper-side portion 74 in the vertical directions Z there is provided a first passageway 76 through which the paper sheet P passes when the cutting apparatus 70 cuts the paper sheet P. The first passageway 76 is provided so that the cutting blade 72 is exposed in an intermediate portion of the first passageway 76. When the paper sheet P passes through the first passageway 76, the paper sheet P contacts the cutting blade 72 and is thereby cut. In short, the casing 71 has the first passageway 76 in which the medium, when passing through the first passageway 76, contacts the cutting blade 72. Then, an introduction opening 76*a* of the first passageway 76 which is at the left side of the cutting blade 72 in the scanning directions X of the casing 71 has been formed so that the vertical size of the introduction opening 76*a* in the vertical directions Z increases toward the left side so as to facilitate introduction of the paper sheet P into the first passageway 76 from the left side of the first passageway 76, that is, the outside thereof.

The casing 71 further has a second passageway 84 in which the medium passing through does not contact the cutting blade 72. Because the casing 71 is provided with the second passageway 84 in which the medium does not contact the cutting blade 72, it is possible to cause one of the medium and the cutting apparatus 70 to move across the other without cutting the medium. Therefore, it is possible to restrain the double cutting of the medium while reducing the load that acts on the medium. Although in this exemplary embodiment, the cutting apparatus 70 cuts the medium by moving in the scanning directions X, other configurations may also be employed to cut the medium. For example, the cutting apparatus 70 may be fixed in position and the medium may be moved in the scanning directions X in order to cut the medium. Furthermore, both the cutting apparatus 70 and the medium may be moved in such directions as to collide each other so that the medium is cut. That is, substantially any configuration may be adopted as long as the cutting apparatus 70 and the medium are moved relative to each other so that the medium is cut. Incidentally, details of the second passageway 84 will be described later.

Furthermore, an upper portion of the lower-side portion 73 which is at the right side of the cutting blade 72 in the scanning directions X of the casing 71 is provided with a first slope surface 77 that extends so as to be inclined to the upper side in the vertical directions Z toward the right side. A left lower portion of the first slope surface 77 which extends from an intermediate portion of the first slope surface 77 forms a portion of the first passageway 76. A terminal end of the first passageway 76 which is in an intermediate portion of the first slope surface 77 and at a side opposite to the introduction opening 76*a* is provided with a guide exit opening 76*b* through which the paper sheet P, after being cut by the cutting blade 72 by passing through the first passageway 76, is guided out of the first passageway 76 to the right side (outside).

A right-side portion of the first slope surface 77 of the casing 71 which is at the right side (outside) of the terminal end of the first passageway 76 has in its intermediate portion a recess portion 78 depressed downward in the vertical directions Z. Inside the recess portion 78 there is provided a rib 79 that extends along the first slope surface 77. That is, the recess portion 78 and the rib 79 are provided in an upper portion of the lower-side portion 73 of the casing 71.

The upper-side portion 74 of the casing 71 which is positioned above the lower-side portion 73 across the first passageway 76 in the vertical directions Z includes an upper surface 80 that extends along the scanning directions X and a second slope surface 81 that is provided at the right side of the upper surface 80 in the scanning directions X and that extends so as to be inclined to the lower side in the vertical directions Z toward the right side. The upper surface 80 and the second slope surface 81 are provided on an upper portion of the upper-side portion 74. The second slope surface 81 is inclined so as to extend toward the first slope surface 77. That is, the upper surface 80 and the second slope surface 81 of the upper-side portion 74 are provided above the first passageway 76 in the vertical directions Z. In other words, in a top view in the vertical directions Z, the upper surface 80 and the second slope surface 81 of the upper-side portion 74 are provided at positions that coincide with the first passageway 76.

Furthermore, the upper-side portion 74 of the casing 71 includes a platy guide portion 82 that extends from the second slope surface 81 toward the first slope surface 77.

The guide portion 82 performs a function of switching between causing the medium to pass through the first passageway 76 and causing the medium to pass through the second passageway 84. That is, the cutting apparatus 70 includes the guide portion 82 that switches between causing the medium to pass through the first passageway 76 and causing the medium to pass through the second passageway 84. Therefore, the passageway through which the medium passes can be changed by the guide portion 82. This guide portion 82 includes a shaft 82*a* provided at a right end of the upper-side portion 74 in the scanning directions X, that is, a right end of the second slope surface 81. The guide portion 82 is pivotable about this shaft 82*a* and displaceable between a first position in which the guide portion 82 opens the guide exit opening 76*b* of the first passageway 76 (the position indicated by a two-dot dashed line in FIG. 4) and a second position in which the guide portion 82 closes the guide exit opening 76*b* of the first passageway 76 (the position indicated by a solid line in FIG. 4). That is, the guide portion 82 can be displaced between the first position in which the guide portion 82 allows the medium to pass through the first passageway 76 when the casing 71 moves from one side to the other side in the scanning directions X and the second position in which the guide portion 82 guides the medium to the second passageway 84 when the casing 71 moves from the other side to the one side. By displacing the guide portion 82 between the first position and the second position according to the moving direction of the casing 71 when the casing 71 moves back and forth in the scanning directions X, the passageway through which the medium is caused to pass can be changed. That is, a simple configuration made up of the guide portion 82 displaceable between the first position and the second position makes it possible to cause the medium to pass through different passageways between during the outgoing movement of the casing 71 and during the returning movement thereof.

The guide portion 82 is displaced from the second position to the first position by the medium passing through the first passageway 76 and contacting the guide portion 82 when the casing 71 moves from the one side to the other side in the scanning directions X. Therefore, the position of the guide portion 82 can be changed without providing a power source, for example, a motor, an actuator, etc.

Furthermore, the guide portion 82, when positioned in the second position, blocks the first passageway 76. This reduces the risk of the medium erroneously passing through the first passageway 76. That is, the double cutting of the medium can be restrained.

Referring to FIGS. 5 and 6, when a shaft 82*a*-side end of the guide portion 82 is termed the proximal end of the guide portion 82, a distal end of the guide portion 82 that is opposite to the proximal end thereof is provided with a cutout 83. As shown in FIG. 5, when the guide portion 82 is positioned in the second position, the distal end of the guide portion 82 is in contact with an inner side surface 78*a* of the recess portion 78 which is a left side surface of the recess portion 78 in the scanning directions X. During this state, the cutout 83 of the guide portion 82 is engaged with the rib 79. Therefore, when positioned in the second position, the guide portion 82 is pivotable counterclockwise about the shaft 82*a* but cannot be pivoted clockwise because the left inner side surface 78*a* of the recess portion 78 serves as a stopper. Furthermore, in order to stabilize the posture of the guide portion 82 in the second position, the guide portion 82 is configured so that gravitation causes a moment to act on the guide portion 82 clockwise about the shaft 82*a*.

Next, operation of the printer (printing apparatus) 11 configured as described above will be described, with a focus particularly on the cutting method for the paper sheet P which uses the cutting apparatus 70. Incidentally, blank arrows in FIGS. 7, 9 and 10 each indicate a direction in which the casing 71 moves.

Figure 7:
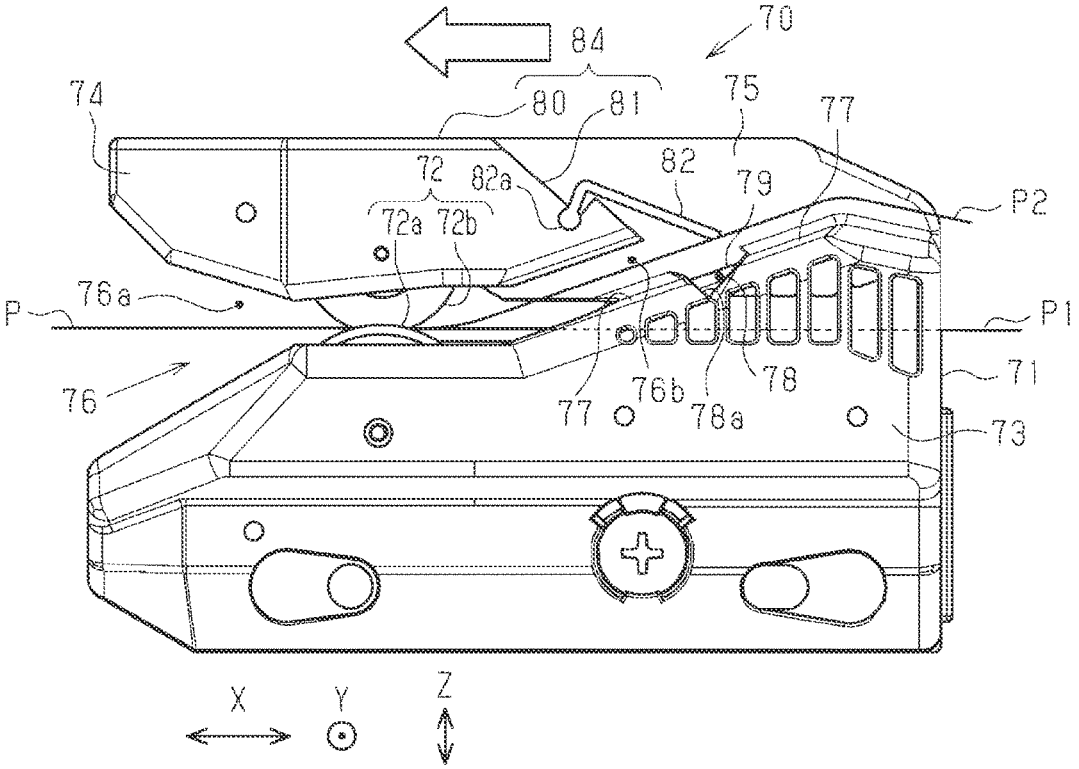
FIG. 7 is a diagram illustrating a state during which the cutting apparatus moves toward a counter-standby position.

As shown in FIG. 7, when the casing 71 moves from the right side (one side) to the left side (other side) in the scanning directions X, that is, moves toward the counter-standby position, in order for the cutting apparatus 70 to cut the paper sheet P, the paper sheet P is introduced, with the right end of the paper sheet P (the one-side end thereof in the scanning directions X) being the leading end, into the first passageway 76 through the introduction opening 76*a* that has an increased opening size in the vertical directions Z. After being introduced into the first passageway 76, the paper sheet P is cut by the cutting blade 72 rotating as the casing 71 moves, so that the paper sheet P is separated into an upstream-side paper sheet P1 continuous with the roll paper sheet R and a downstream-side paper sheet P2 that has been cut into a cut sheet and that is to be let out to the downstream side in the transport direction Y.

Then, as the casing 71 moves toward the counter-standby position on the left side in the scanning directions X, the right end portion of the downstream-side paper sheet P2 in the scanning directions X relatively moves along the first slope surface 77 toward the guide exit opening 76*b* of the first passageway 76. During this state, the posture of the guide portion 82 is stable in the second position due to gravitation, with the distal end of the guide portion 82 being in contact with the left inner side surface 78*a* of the recess portion 78 and therefore closing the guide exit opening 76*b*. However, as the casing 71 moves, the right end portion of the downstream-side paper sheet P2 comes into contact with the guide portion 82 to push the guide portion 82 from a lower left side to an upper right side.

Then, the guide portion 82 pivots clockwise about the shaft 82*a* and is thus displaced from the second position to the first position, so that the guide exit opening 76*b* of the first passageway 76 opens. That is, the guide portion 82 is displaced from the second position to the first position that allows the paper sheet P (specifically, the downstream-side paper sheet P2) to pass through the first passageway 76. Then, the downstream-side paper sheet P2 is guided to the outside of the first passageway 76 through the opened guide exit opening 76*b*. After having passed through the first passageway 76, the downstream-side paper sheet P2 passes over the upper portion of the lower-side portion 73 of the casing 71, moving along the first slope surface 77 as the casing 71 moves.

Figure 8:
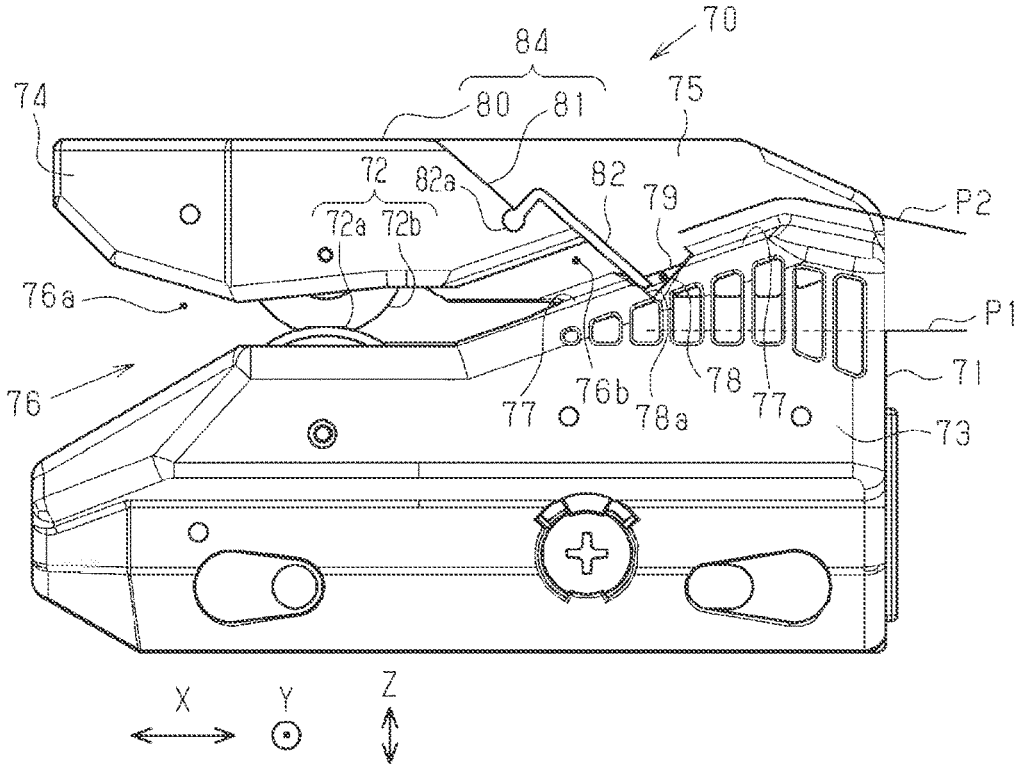
FIG. 8 is a diagram illustrating a state during which the cutting apparatus is positioned at the counter-standby position.

As shown in FIG. 8, when the movement of the casing 71 toward the counter-standby position ends, the cutting of the paper sheet P by the cutting apparatus 70 is completed, that is, the paper sheet P is separated, over the entire range in the scanning directions X, into the upstream-side paper sheet P1 and the downstream-side paper sheet P2. At this time, the downstream-side paper sheet P2, having passed through the first passageway 76, is supported at its left end portion in the scanning directions X by a right end portion of the first slope surface 77. Furthermore, when the left end portion of the downstream-side paper sheet P2 is guided to the outside of the first passageway 76 through the guide exit opening 76*b*, the guide portion 82 is displaced from the first position to the second position due to gravitation.

Figure 9:
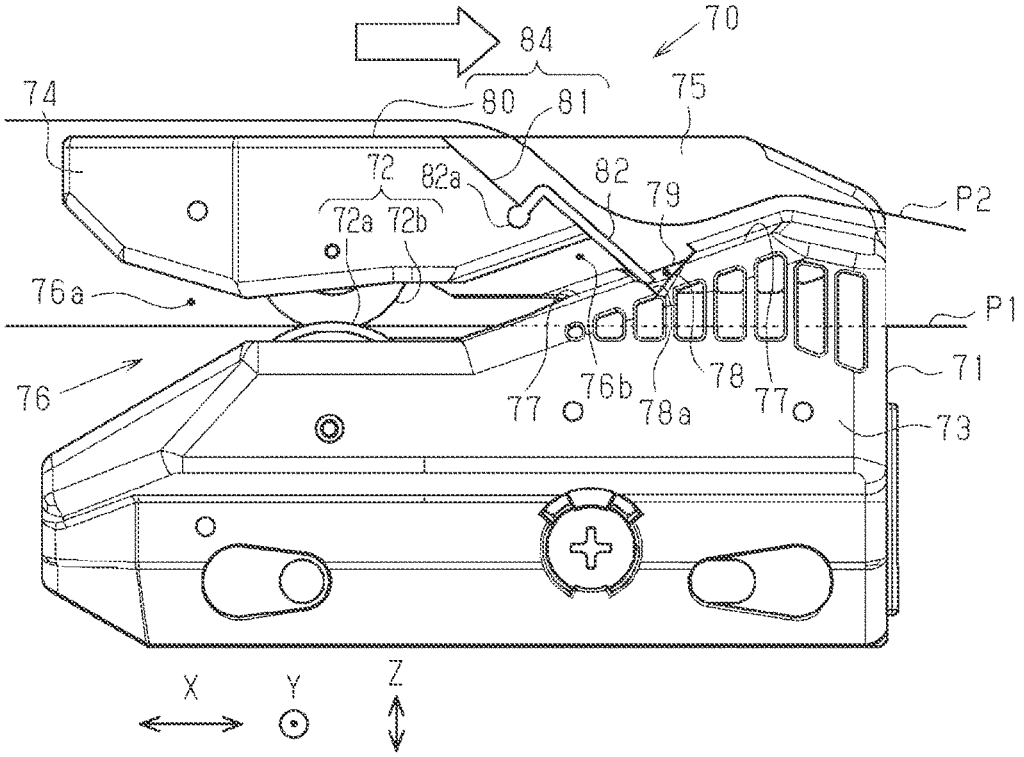
FIG. 9 is a diagram illustrating a state during which the cutting apparatus moves a standby position.

As shown in FIG. 9, after the cutting of the paper sheet P by the cutting apparatus 70 is completed, the casing 71 is then moved from the left side (other side) toward the right side (one side) in the scanning directions X, that is, toward the standby position. At this time, the left end portion of the downstream-side paper sheet P2 in the scanning directions X comes into contact with the guide portion 82. However, the guide portion 82, whose distal end has been stopped by the left inner side surface 78*a* of the recess portion 78, is not displaced so as to open the guide exit opening 76*b* of the first passageway 76. Therefore, the downstream-side paper sheet P2 is blocked from entering the first passageway 76 from a right end portion of the first slope surface 77 by the guide portion 82 positioned in the second position.

Instead, the downstream-side paper sheet P2 is guided along the surface of the guide portion 82 toward the second slope surface 81 of the upper-side portion 74 of the casing 71. That is, the downstream-side paper sheet P2 is guided to the second slope surface 81 formed on the upper-side portion 74 and the upper surface 80 of the upper-side portion 74 by the guide portion 82 positioned in the second position as the casing 71 moves from the left side (other side) to the right side (one side) in the scanning directions X.

Note that, unlike the first passageway 76, the passageway through which the downstream-side paper sheet P2 passes when guided to the second slope surface 81 and the upper surface 80 of the upper-side portion 74 by the guide portion 82 does not have the cutting blade 72 exposed. Therefore, the passageway through which the downstream-side paper sheet P2 passes when guided to the second slope surface 81 and the upper surface 80 of the upper-side portion 74 functions as the second passageway 84 that does not have the cutting blade 72. Hence, when the casing 71 movable back and forth in the scanning directions X moves in the outgoing direction, the paper sheet P passes through the first passageway 76 and is therefore cut; on the other hand, when the casing 71 moves in the returning direction, the paper sheet P having been cut passes through the second passageway 84. Thus, the risk of the double cutting of the paper sheet P is reduced.

Figure 10:
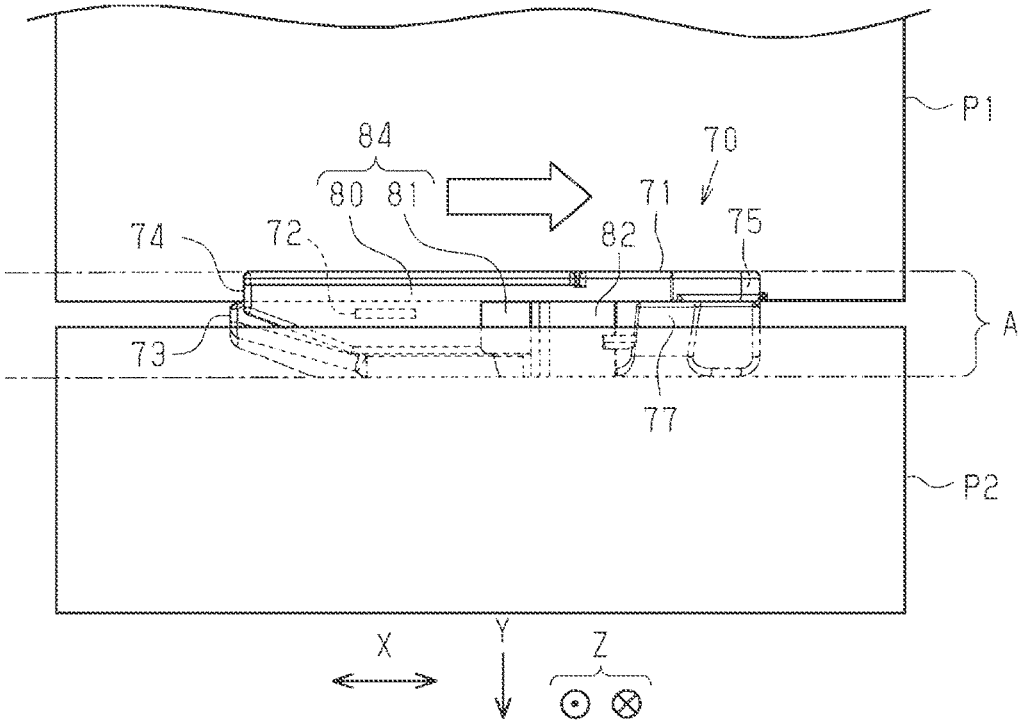
FIG. 10 is a top view showing the state shown in FIG. 9.

FIG. 10 is a diagram showing a top view of the cutting apparatus 70 viewed from above. FIG. 10 shows, similarly to FIG. 9, a state in which the cutting apparatus 70 moves toward the standby position. As shown in FIG. 10, when the casing 71 moves toward the standby position, the downstream-side paper sheet P2 having been cut and separated is guided to the second passageway 84 of the casing 71 by the guide portion 82 and therefore passes over an upper portion of the casing 71. The first passageway 76 and the second passageway 84 of the casing 71 are provided at positions that substantially coincide with each other when viewed in the vertical directions Z, which intersect with both the transport direction Y and the scanning directions X. In other words, in a top view of the casing 71, the first passageway 76 and the second passageway 84 are provided at positions where the first passageway 76 and the second passageway 84 at least partially overlap with each other. Therefore, in a top view of the casing 71, the area that the first passageway 76 and the second passageway 84 occupy has been made small. Hence, this contributes to a compact configuration of the cutting apparatus 70. Note that, the terms "top view" and "viewed from above" in this specification both refer to the viewing of the cutting apparatus 70 from an angle of view as in FIG. 10 (from a direction in which the surface of the medium to be cut is seen below).

When the first passageway 76 and the second passageway 84 are provided at positions that coincide with each other when viewed in the vertical directions Z, which intersect with both the transport direction Y and the scanning directions X, the risk of the downstream-side paper sheet P2 being pushed toward the downstream side in the transport direction Y from a movement region A of the casing 71 in a top view in the vertical directions Z is small. That is, the load that acts on the downstream-side paper sheet P2 is reduced in comparison with a configuration in which, when the casing 71 movable back and forth in the scanning directions X moves in the returning direction, the downstream-side paper sheet P2 having been cut during the outgoing movement is pushed out toward the outside of the movement region A of the casing 71. Particularly, in comparison with the configuration in which the downstream-side paper sheet P2 is pushed out toward the downstream side in the transport direction Y, the cutting apparatus 70 in the exemplary embodiment reduces the load that acts on the downstream-side paper sheet P2 because the downstream-side paper sheet P2 is not pushed downstream out of the movement region A of the casing 71.

Incidentally, as stated above, the printing apparatus according to this exemplary embodiment includes the cutting apparatus 70 and the printing section 50 that prints images on a medium. In such printing apparatuses, it is possible to restrain the double cutting of a medium while reducing the load that acts on the medium.

Furthermore, a cutting method for a medium according to this exemplary embodiment is a cutting method employed by the cutting apparatus 70 that includes the cutting blade 72 that cuts the medium, the first passageway 76 in which the medium passing through contacts the cutting blade 72, and the second passageway 84 in which the medium passing through does not contact the cutting blade 72. This cutting method is characterized in that when the medium is caused to pass through the first passageway 76, the medium is cut, and that when the medium is caused to pass through the second passageway 84, the medium is not cut. In this cutting method, the use of the casing 71 equipped with the second passageway 84 in which the medium does not contact the blade makes it possible to cause one of the medium and the cutting apparatus 70 to move across the other without cutting the medium. Therefore, it is possible to restrain the double cutting of the medium while reducing the load that acts on the medium.

According to the foregoing exemplary embodiment, advantageous effects as follows can be achieved.

(1) When the casing 71 moves back and forth in the scanning directions X that intersect with the transport direction Y in which the paper sheet P is transported, the paper sheet P having been cut by causing the paper sheet P to pass through the first passageway 76 provided in the casing 71 is caused to pass through the second passageway 84 that is provided in the casing 71. Therefore, it is possible to restrain the double cutting of the paper sheet P without pushing the paper sheet P out to a downstream-side region in the transport direction Y which is outside the movement region A of the casing 71. Hence, it is possible to restrain the double cutting of the paper sheet P while reducing the load that acts on the paper sheet P.

(2) The paper sheet P having been cut when passing through the first passageway 76 equipped with the cutting blade 72 is not pushed out to the downstream side in the transport direction Y when guided to the second passageway 84 that is not equipped with the cutting blade 72 by the guide portion 82 provided in the upper-side portion 74 of the casing 71. Therefore, it is possible to restrain the double cutting of the paper sheet P while reducing the load that acts on the paper sheet P.

(3) The passageway through which the paper sheet P is caused to pass can be changed by displacing the guide portion 82 between the first position in which the guide portion 82 allows the paper sheet P to pass through the first passageway 76 and the second position in which the guide portion 82 guides the paper sheet P to the second passageway 84, according to the moving direction of the casing 71 when the casing 71 moves back and forth in the scanning directions X. That is, the simple configuration made up of the guide portion 82 displaceable between the first position and the second position makes it possible to guide the paper sheet P to pass through different passageways between during the outgoing movement of the casing 71 and during the returning movement of the casing 71.

(4) The guide portion 82 is displaced from the second position to the first position by the paper sheet P passing through the first passageway 76 and contacting the guide portion 82 when the casing 71 moves from the standby position toward the counter-standby position in the scanning directions X. Then, when the passage of the paper sheet P through the first passageway 76 is completed, the guide portion 82 is displaced from the first position to the second position by gravitation. That is, the position of the guide portion 82 can be displaced without employing a power source, for example, a motor, an actuator, etc. Thus, the foregoing exemplary embodiment contributes to energy saving. Furthermore, the paper sheet P can be guided to the second passageway 84 merely by adopting a simple configuration.

(5) The guide portion 82, when positioned in the second position, closes the guide exit opening 76*b* of the first passageway 76. Therefore, when the casing 71 moves from the counter-standby position toward the standby position in the scanning directions X, the paper sheet P is blocked from entering the first passageway 76. That is, the risk of the paper sheet P passing through the first passageway 76 again after having once passed through the first passageway 76 and been cut is reduced, and therefore the double cutting of the paper sheet P can be restrained.

(6) The area that the first passageway 76 and the second passageway 84 occupy in the transport direction Y in which the paper sheet P is transported can be reduced. In this respect, the foregoing exemplary embodiment contributes to a compact configuration of the cutting apparatus 70.

(7) When the downstream-side paper sheet P2 passes through the second passageway 84, the rear end of the downstream-side paper sheet P2 that is on the upstream side in the transport direction Y is raised by the second slope surface 81 and the upper surface 80 of the upper-side portion 74 of the casing 71. This facilitates the exit of the downstream-side paper sheet P2 through the outlet opening 17 of the printer 11.

The foregoing exemplary embodiment may be changed as follows.

In the foregoing exemplary embodiment, the second passageway 84 is not limited to the configuration in which the second passageway 84 is provided above the first passageway 76 in the vertical directions Z but the second passageway 84 may be provided below the first passageway 76.

In the foregoing embodiment, the guide portion 82 is not limited to the configuration in which the guide portion 82 is pivoted to be displaced to the first position and the second position. For example, the guide portion 82 may be an open-close door that is slid along the second slope surface 81 to be displaced to the first position and the second position.

In the foregoing exemplary embodiment, the guide portion 82 may be displaced to the first position and the second position by a power source such as a motor or an actuator.

In the foregoing exemplary embodiment, the distal end of the guide portion 82 may be provided with a rotating piece. Since the distal end of the guide portion 82 contacts the paper sheet P that is guided out of the guide exit opening 76*b* of the first passageway 76, the provision of the rotating piece further reduces the load that acts on the paper sheet P. Furthermore, this also reduces the risk that the image printed on the paper sheet P by the printing section 50 may be stained or damaged by contact with the distal end of the guide portion 82. The rotating piece may be a star wheel whose peripheral edge has protruded teeth. The use of a star wheel as the rotating piece reduces the frictional resistance between the rotating piece and the paper sheet P contacting each other. However, a roller that is not equipped with any teeth may instead be used as the rotating piece. Use of a roller not equipped with any teeth will reduce the possibility of damaging the paper sheet P at the time of contact between the paper sheet P and the rotating piece.

In the exemplary embodiment, the guide portion 82 is not limited to the configuration in which the guide portion 82 is displaceable to the first position and the second position. For example, the guide portion 82 may be configured to guide the paper sheet P having been cut to the second slope surface 81 by jetting air to the paper sheet P from below in the vertical directions Z when the casing 71 moves in the returning direction.

In the foregoing exemplary embodiment, the guide portion 82 is not limited to the configuration in which the guide portion 82 is provided on the upper-side portion 74 of the casing 71. The guide portion 82 may be provided on the lower-side portion 73.

In the foregoing exemplary embodiment, the recess portion 78 and the rib 79 that are formed on the first slope surface 77 may be omitted.

In the foregoing exemplary embodiment, the cutting blade 72 of the cutting apparatus 70 is not limited to the configuration in which the cutting blade 72 is rotated as the casing 71 moves. The cutting blade 72 may be rotationally driven by a power source such as a motor that is separately provided.

In the foregoing exemplary embodiment, the cutting apparatus 70 may also be configured to cause the paper sheet P to pass through the second passageway 84 during the outgoing movement of the casing 71 when the casing 71 moves back and forth in the scanning directions X and to cause the paper sheet P to pass through the first passageway 76 during the returning movement of the casing 71.

In the foregoing exemplary embodiment, the medium that the cutting apparatus 70 cuts is not limited to paper but may be various sheet-shaped media such as cloths, metal foils, and plastic sheets.

In the foregoing exemplary embodiment, the printing section 50 of the printer 11 is not limited to the configuration in which the printing section 50 prints on a paper sheet P by discharging ink to the paper sheet P. For example, the printing section 50 may be configured to print by using toner or other various printing agents.

In the foregoing exemplary embodiment, the printing section 50 of the printer 11 is not limited to a serial head type that prints on the paper sheet P by moving back and forth in the scanning directions X. For example, the printing section 50 may be of a line head type printing section 50 whose head is elongated in the scanning directions X or may also be of a lateral type.

In the foregoing exemplary embodiment, the transport section 30 that transports the paper sheet P is not limited to rollers but may also be a conveyor or transporter belt.

This application claims priority under 35 U.S.C. §119 to Japanese Patent Application No. 2015-137840, filed Jul. 9, 2015. The entire disclosure of Japanese Patent Application No. 2015-137840 is hereby incorporated herein by reference.

What is claimed is:

1. A cutting apparatus comprising:

a cutting blade that cuts a medium;

a casing that holds the cutting blade and that has a first passageway in which the medium passing through contacts the cutting blade and a second passageway in which the medium passing through does not contact the cutting blade; and a guide portion that is displaceable to a first position in which the guide portion allows the medium to pass through the first passageway and a second position in which the guide portion guides the medium to the second passageway, wherein the guide portion is displaced from the second position to the first position by the medium passing through the first passageway and contacting the guide portion.

2. The cutting apparatus according to claim 1, wherein the guide portion blocks the first passageway when the guide portion is positioned in the second position.

3. The cutting apparatus according to claim 1, wherein when the casing is viewed from above, the first passageway and the second passageway are provided at positions at which the first passageway and the second passageway at least partially overlap with each other.

4. A printing apparatus comprising:

the cutting apparatus according to claim 1; and a printing portion that prints an image on the medium.

* * * * *